US006118424A

United States Patent [19]

Suzuki

[11] Patent Number: 6,118,424

[45] Date of Patent: Sep. 12, 2000

[54] METHOD OF DRIVING ANTIFERROELECTRIC LIQUID CRYSTAL DISPLAY

[75] Inventor: Yasushi Suzuki, Sayama, Japan

[73] Assignee: Citizen Watch Co., Ltd., Tokyo, Japan

[21] Appl. No.: 08/992,671

[22] Filed: Dec. 17, 1997

Related U.S. Application Data

[63] Continuation of application No. 08/461,449, Jun. 5, 1995, abandoned.

[51] Int. Cl.[7] ..... G09G 3/36

[52] U.S. Cl. ..... 345/100; 345/87

[58] Field of Search ..... 345/94, 87, 95, 345/99, 100; 349/174

[56] References Cited

U.S. PATENT DOCUMENTS

| | | | |
|---|---|---|---|
| 5,367,391 | 11/1994 | Johno et al. | 345/97 |
| 5,420,604 | 5/1995 | Scheffer et al. | 345/100 |
| 5,434,599 | 7/1995 | Hirai et al. | 345/100 |
| 5,459,481 | 10/1995 | Tanaka et al. | 345/95 |
| 5,459,482 | 10/1995 | Orlen | 345/87 |
| 5,473,338 | 12/1995 | Prince et al. | 345/94 |
| 5,481,651 | 1/1996 | Herold | 345/94 |
| 5,485,173 | 1/1996 | Scheffer et al. | 345/100 |
| 5,489,919 | 2/1996 | Kuwata et al. | 345/100 |
| 5,508,716 | 4/1996 | Prince et al. | 345/100 |
| 5,546,102 | 8/1996 | Scheffer et al. | 345/100 |
| 5,555,110 | 9/1996 | Konuma et al. | 349/33 |
| 5,646,755 | 7/1997 | Okada et al. | 345/97 |
| 5,886,755 | 3/1999 | Imoto et al. | 349/37 |

FOREIGN PATENT DOCUMENTS 2-153322 6/1990 Japan .

OTHER PUBLICATIONS

Rademacher functions, H. Rademacher, Walsh analysis, 1993, Tokyo Denki University with translation of pertinent portions of article.

Active Addressing TM of STN displays for high–performance video applications T.J. Scheffer et al., Displays, vol. 14, No. 2, 1993, pp. 74–85.

*Primary Examiner*—Kent Chang

*Attorney, Agent, or Firm*—Finnegan, Henderson, Farabow, Garrett & Dunner, L.L.P.

[57] ABSTRACT

A method simultaneously drives a plurality of lines of a display employing an antiferroelectric liquid crystal material. The polarity of the start of a waveform applied to a first one of the simultaneously selected lines is opposite to the polarity of the starts of waveforms applied to the other simultaneously selected lines. Each select period is divided into n sections. A data waveform applied to any one of data electrodes (column electrodes) of the display in synchronization with the select waveforms is determined according to column vectors of a unit matrix of n rows by n columns. The sign of a first one of the n column vectors is inverted. A maximum among voltages applied to pixels of the display must be sufficiently larger than the threshold of the ferroelectric liquid crystal material. The absolute value of the threshold is set between the sum of and the difference between the absolute values of the select and data waveforms.

3 Claims, 2 Drawing Sheets

METHOD OF DRIVING ANTIFERROELECTRIC LIQUID CRYSTAL DISPLAY

This is a continuation of application Ser. No. 08/461,449, filed Jun. 5, 1995, now abandoned.

BACKGROUND OF THE INVENTION

1. Field of the Invention

The present invention relates to a method of driving an antiferroelectric liquid crystal display.

2. Description of the Related Art

A method of driving an antiferroelectric liquid crystal display is disclosed in, for example, Japanese Unexamined Patent Publication No. 2-153322. This disclosure defines a line-select waveform by a voltage V and a select time t and successively applies the waveform to lines of the display, to select the lines one after another at intervals of the time t. For example, the second line is selected after a delay of t1 after the first line, and the third and fourth lines are selected after delays of 2t1 and 3t1, respectively, after the first line. In this way, the prior art selects the lines one by one in time series.

A time necessary for selecting (scanning) all lines of a display, i.e., a frame frequency is dependent on the properties, in particular, the coefficient of viscosity of a liquid crystal material employed by the display. To improve display speed, it is important to improve the liquid crystal material. It is more important, however, to provide a technique of driving presently available liquid crystal materials at high speed. According to the prior art, the frame frequency of a display is proportional to the number of lines of the display, and therefore, the prior art is incapable of driving a display that has a large number of lines.

SUMMARY OF THE INVENTION

An object of the present invention is to provide a method of driving a display having a matrix of pixels made of antiferroelectric liquid crystal material and a plurality of scan and signal electrodes that face each other. The method applies waveforms to the scan and signal electrodes to drive the pixels. The method determines waveforms applied to the scan electrodes according to a Walsh function, i.e., an orthogonal periodic function.

When simultaneously driving selected lines of the display, this method systematically designs waveforms applied to the selected lines and data columns according to the Walsh function. This method easily estimates basic data waveforms and an actual data waveform applied to selected pixels.

DESCRIPTION OF THE PREFERRED EMBODIMENTS

To realize a high-speed response, the present invention simultaneously selects a plurality of lines of a liquid crystal display. Waveforms used to simultaneously select lines are determined according to a Walsh function 1 described in, for example, T. J. Scheffer and B. Clifton "Active Addressing Method for High-Contrast Video Rate STN Display" SID 92 Digest, p. 228. Namely, the waveforms are determined as follows:

(1) The polarity of the start of a waveform applied to a first one of the selected lines is opposite to the polarity of the starts of waveforms applied to the other selected lines.

(2) When the number of the simultaneously selected lines is n, a select period is divided into n sections.

(3) Basic data waveforms applied to data electrodes (columns) in synchronization with the line-select waveforms are represented with column vectors. When a unit matrix of n rows by n columns is used, there will be first to "n"th column vectors. The sign of the first column vector is inverted.

(4) To turn ON a pixel in a line j in a column k, a waveform determined by the "j"th column vector in the unit matrix of the above (3) is applied to the column k.

(5) To turn ON pixels in lines i and j in the column k, a waveform determined by the sum of the "i"th and "j"th column vectors in the unit matrix of the above (3) is applied to the column k.

(6) A maximum voltage applied to a pixel is the sum of the absolute value of a line-select waveform and the absolute value of a data waveform. The absolute value of the threshold of the antiferroelectric liquid crystal material is set between the sum of and the difference between the absolute values of the line-select and data waveforms.

First Embodiment

Figure 1A:
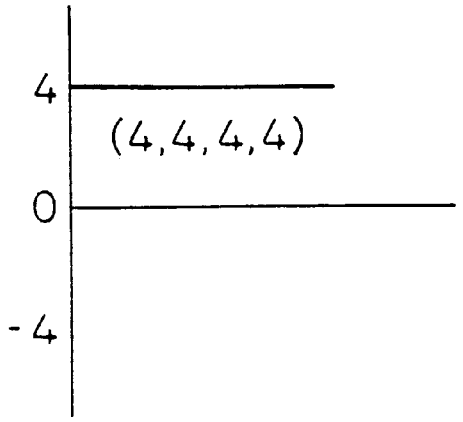
FIG. 1 (A–D) show waveforms simultaneously applied to selected lines of a display according to a first embodiment of the present invention.
Figure 1C:
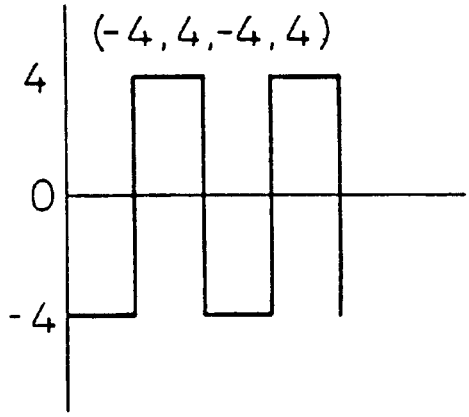
Figure 1B:
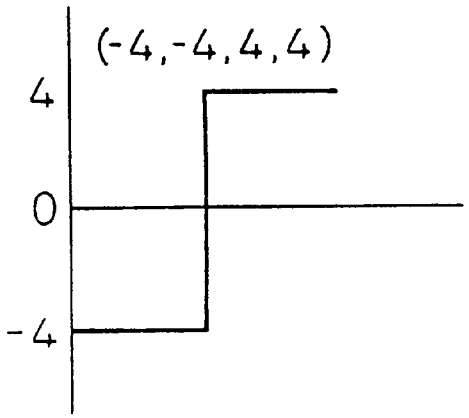
Figure 1D:
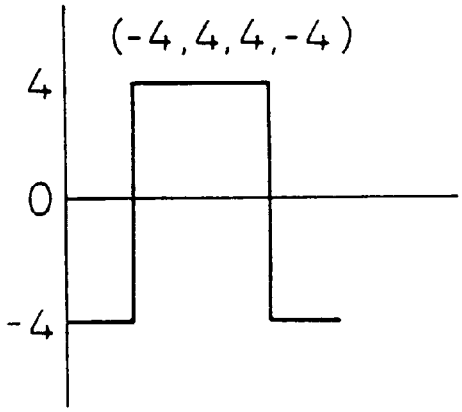
Figure 2:
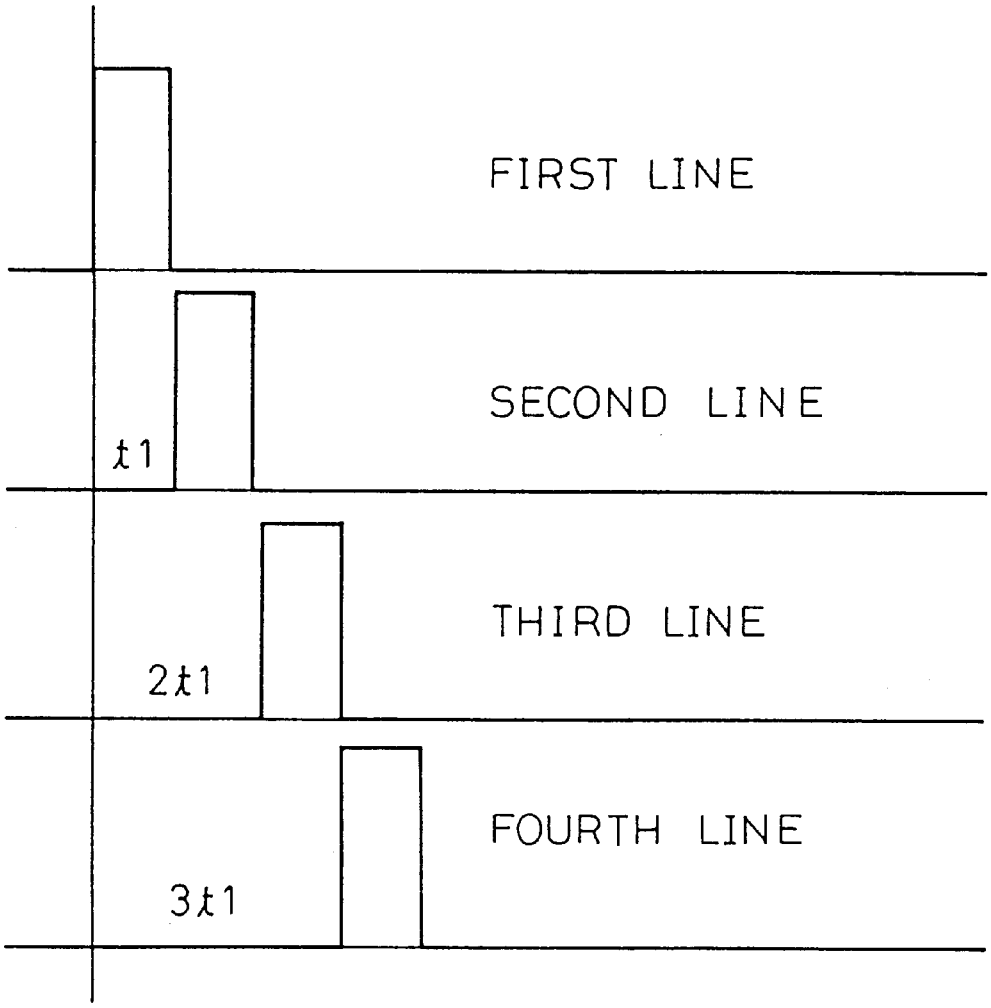
Fig. 2 (Prior Art)
FIG. 2 shows waveforms applied one after another to respective lines of a display according to a prior art.

FIG. 1 shows line-select waveforms simultaneously applied to the scan electrodes of selected lines of a display employing an antiferroelectric liquid crystal material, according to the first embodiment of the present invention. As a comparison, FIG. 2 shows line-select waveforms applied to scan electrodes according to a conventional sequential driving method. To prevent a deterioration of the liquid crystal material, the line-select waveforms are usually alternated with respect to a time axis. Namely, the waveforms of FIG. 1 are followed by the inversions thereof. In this case, data waveforms are followed by those multiplied by −1. The inversions are not necessarily added to the waveforms of FIG. 1.

The line-select waveforms of FIG. 1 simultaneously select four lines at time t1. Each select period is divided into four sections according to the number of the simultaneously selected lines. The line-select waveforms are represented with vectors, which clarifies time-series changes in the waveforms in each select period. The line-select waveforms V1 to V4 corresponding to reference marks (A) to (D) in FIG. 1 are represented as follows:

V1=(4, 4, 4, 4)

V2=(−4, −4, 4, 4)

V3=(−4, 4, −4, 4)

V4=(−4, 4, 4, −4)

Turning ON a pixel in the first line among the selected four lines will now be explained. The problem is a data waveform applied to a signal electrode with respect to the voltages V1 to V4 applied to the selected four lines.

Elements in first to fourth columns in a matrix of four rows by four columns are as follows:

D1'=(1, 0, 0, 0)

D2 (0, 1, 0, 0)

D3 (0, 0, 1, 0)

D4 (0, 0, 0, 1)

The first column D1'=(1, 0, 0, 0) is inverted into D1=(−1, 0, 0, 0), and the first to fourth columns D1 to D4 are used to form basic data waveforms.

To turn ON a pixel in the first line, a data waveform corresponding to the column vector D1 is applied to the first to fourth lines as follows:

$$(4,4,4,4)-(-1,0,0,0)=(5,4,4,4) \quad (1)$$

$$(-4,-4,4,4)-(-1,0,0,0)=(-3,-4,4,4) \quad (2)$$

$$(-4,4,-4,4)-(-1,0,0,0)=(-3,4,-4,4) \quad (3)$$

$$(-4,4,4,-4)-(-1,0,0,0)=(-3,4,4,-4) \quad (4)$$

If the threshold of the antiferroelectric liquid crystal material is set between voltage levels 4 and 5, only the first line receives a voltage above the threshold, and the other lines receive voltages below the threshold. Namely, when the data waveform corresponding to the vector (−1, 0, 0, 0) is applied to the four lines, only a first pixel is turned ON, and second to fourth pixels are not turned ON. To separately turn ON the second to fourth pixels, the vectors D2 to D4 are sequentially selected, and corresponding data waveforms are applied in synchronization with the line-select waveforms.

Simultaneously turning ON, for example, second and third pixels will now be explained. In this case, the sum of the vectors D2 and D3 is adopted to form a data waveform as follows:

(0, 1, 0, 0)+(0, 0, 1, 0)=(0, 1, 1, 0)

Then, the following voltages are applied to pixels:

$$(4,4,4,4)-(0,1,1,0)=(4,3,3,4) \quad (5)$$

$$(-4,-4,4,4)-(0,1,1,0)=(-4,-5,3,4) \quad (6)$$

$$(-4,4,-4,4)-(0,1,1,0)=(-4,3,-5,4) \quad (7)$$

$$(-4,4,4,-4)-(0,1,1,0)=(-4,3,3,-4) \quad (8)$$

Unlike a nematic liquid crystal material, the antiferroelectric liquid crystal material changes its state when the product of an applied voltage and an application time exceeds a given value. Unlike a ferroelectric liquid crystal material, the antiferroelectric liquid crystal material changes its state if the absolute value of an applied voltage exceeds the absolute value of the threshold thereof. When the threshold is between levels 4 and 5, the absolute value of −5 in each of the expressions (6) and (7) is above the threshold. Namely, the second and third pixels receive voltages each above the threshold, and therefore, change their states. On the other hand, the first and fourth pixels receive voltages each below the threshold, and therefore, there is no change in their states. Consequently, the data waveform corresponding to the vector (0, 1, 1, 0) turns ON the second and third pixels.

To turn OFF all pixels, a data waveform corresponding to a vector (0, 0, 0, 0) is used. In this case, voltages applied to the pixels are equal to the line-select waveforms, and therefore, none of the applied voltages exceeds the threshold set between the levels 4 and 5. Consequently, no pixel is turned ON.

Although the above embodiment sets the voltage level applied to simultaneously selected lines to 4, this does not limit the present invention. Any level greater than 2 is usable.

Second embodiment

When simultaneously selecting eight lines of the display employing the antiferroelectric liquid crystal material, the second embodiment of the present invention uses, for example, the following line-select waveforms:

V1=(4, 4, 4, 4, 4, 4, 4, 4)
V2=(−4, −4, −4, −4, 4, 4, 4, 4)
V3=(−4, −4, 4, 4, 4, 4, −4, −4)
V4=(−4, −4, 4, 4, −4, −4, 4, 4)
V5=(−4, 4, 4, −4, −4, 4, 4, −4)
V6=(−4, 4, 4, −4, 4, −4, −4, 4)
V7=(−4, 4, −4, 4, 4, −4, 4, −4)
V8=(−4, 4, −4, 4, −4, 4, −4, 4)

Vectors to form basic data waveforms are as follows:

D1=(−1, 0, 0, 0, 0, 0, 0, 0)
D2=(0, 1, 0, 0, 0, 0, 0, 0)
D3=(0, 0, 1, 0, 0, 0, 0, 0)
D4=(0, 0, 0, 1, 0, 0, 0, 0)
D5=(0, 0, 0, 0, 1, 0, 0, 0)
D6=(0, 0, 0, 0, 0, 1, 0, 0)
D7=(0, 0, 0, 0, 0, 0, 1, 0)
D8=(0, 0, 0, 0, 0, 0, 0, 1)

The line-select waveforms V1 to V8 are not necessarily in four levels. Any number of levels greater than two is usable. These waveforms may be alternately inverted, similar to the first embodiment.

Any one or a plurality of eight pixels are turned ON by applying a data waveform corresponding to the sum of proper ones of the vectors D1 to D8. At this time, the threshold of the liquid crystal material may be set between voltage levels 4 and 5, similar to the first embodiment. This technique is applicable to simultaneously selecting 32, 64, or a greater number of lines.

As explained above, the present invention employs a Walsh function to systematically design waveforms simultaneously applied to selected lines and a data column of an antiferroelectric liquid crystal display. The present invention lets a user easily estimate basic data waveforms and an actual data waveform applied to selected pixels.

According to the present invention, points at which selected pixels are turned ON are distributed at random in a select period. This effect becomes more advantageous as the number of simultaneously selected lines exceeds eight. According to the sequential driving technique of the prior art of FIG. 2, lines are sequentially selected one by one from the top to the bottom of the display. This regular sequential scanning of the lines causes flickering and fluctuations, which deteriorates display quality. On the other hand, the present invention simultaneously drives a plurality of lines, and a user may sense if the selected pixels and selected lines are uniformly turned ON.

This embodiment is temporally equivalent to a one-pulse method that applies reset and select pulses one after another. Accordingly, the method of the present invention may substitute for the one-pulse method that has several problems. The method of the present invention provides a faster response speed than a conventional two-pulse method and realizes the same contrast and view angle as those of the prior art.

The simultaneous driving method of the present invention is effective when driving a display having 200 lines or greater. According to the present invention, positive and negative pulses of line-select waveforms in each select period substantially cancel each other, so that data waveforms may be designed without regard to neutralization of charges. Due to this, the present invention allows the line-select waveforms to be alternately inverted at intervals of 100 to 1000 times longer than those of the prior art.

According to the present invention, each select period involves not only ON-level signals (signals of level 5 in the first and second embodiments) but also OFF-level signals (signals of levels 3, 4, etc., in the embodiments). On the other hand, the prior art suddenly applies an ON-level signal. It is apparent that a high-speed response is achievable when the level 5 signal is applied in an environment involving the signals of levels 3, 4, etc.

What is claimed is:

1. A method of driving a display having a matrix of pixels made of antiferroelectric liquid crystal material and a plurality of scan and signal electrodes facing each other, comprising the steps of:

applying scan waveforms to the scan electrodes and signal waveforms to the signal electrodes to drive the antiferroelectric liquid crystal pixels at a peak value;

the polarity of the start of the scan waveform applied to the scan electrode of a first one of a plurality of simultaneously scanned lines is opposite to the polarity of the start of the scan waveforms applied to the scan electrodes of the other of the plurality of simultaneously scanned lines;

determining, when n lines of the signal electrodes are simultaneously scanned, the voltage signal waveform to be applied to any one of the signal electrodes according to n column vectors of a unit matrix of n rows by n columns with the sign of the first column vector being inverted; and setting the threshold voltage of the antiferroelectric liquid crystal to an intermediate value between the sum value of the absolute values of the scan voltage waveforms and the signal voltage waveforms and the difference value between the absolute values of the scan voltage waveforms and the signal voltage waveforms.

2. The method according to claim 1 further including the step of determining the scan waveforms applied to the scan electrodes according to a Walsh function.

3. The method according to claim 2 wherein the scan waveforms applied to the scan electrodes involve at least two levels.

* * * * *